US005199633A

United States Patent [19]

Jantzen et al.

[11] Patent Number: 5,199,633

[45] Date of Patent: Apr. 6, 1993

[54] DRINKING AID

[76] Inventors: L. Arthur Jantzen, 18 Spruce Ter., Wayne, N.J. 07470; Raymond Maguire, 1668 SW. Buckskin Trail, Stuart, Fla. 34997

[21] Appl. No.: 923,567

[22] Filed: Aug. 3, 1992

[51] Int. Cl.[5] ..... B65D 3/28

[52] U.S. Cl. ..... 229/103.1; 215/1 A; 220/710

[58] Field of Search ..... 229/103.1; 220/705, 220/710; 215/1 A; 222/74, 211, 464, 566, 574

[56] References Cited

U.S. PATENT DOCUMENTS

| | | | |
|---|---|---|---|
| 3,456,850 | 7/1969 | Uhlmann | 222/211 |
| 3,462,061 | 8/1969 | Shore | 229/103.1 |
| 3,774,804 | 11/1973 | Henning | 220/705 |
| 3,980,210 | 9/1976 | Kligerman | 215/1 A |
| 4,251,019 | 2/1981 | Cone | 215/1 A |
| 4,252,256 | 2/1981 | Walsh | 215/1 A |
| 4,573,631 | 3/1986 | Reeves | 220/710 |
| 4,928,857 | 5/1990 | Ecker | 222/211 |
| 4,982,854 | 1/1991 | Ichimiya | 220/710 |
| 5,078,286 | 1/1992 | Hashimoto | 220/710 |

FOREIGN PATENT DOCUMENTS

| | | | |
|---|---|---|---|
| 566676 | 12/1932 | Fed. Rep. of Germany | 215/1 A |
| 499756 | 11/1919 | France | 220/710 |
| 978901 | 1/1965 | United Kingdom | 229/103.1 |

*Primary Examiner*—Gary E. Elkins
*Attorney, Agent, or Firm*—Bernard J. Murphy

[57] ABSTRACT

A cylindrical container, having an open top, closed bottom, and an annular wall, has an aperture formed through the wall in immediate adjacency to the closed bottom. An articulated tube is removably set into the aperture, to enable gravity-fed flow of container-held fluid, in order that persons with poor or deteriorated motor skills can drink with more facility.

12 Claims, 1 Drawing Sheet

DRINKING AID

This invention pertains to cups, drinking tumblers, and the like, and in particular to a container for fluid and an elongate tube therefor and in combination therewith, for use as an aid in drinking.

Elderly persons, those afflicted with cerebal palsy, and others who have poor or deteriorated motor skills, have marked difficulty in drawing fluid from a container. Putting the open top of the container to the lips results in spillage. Too, the use of a straw set into the open top of the container is inadequate, in that the subject persons can not create the necessary vacuum in the straw. The answer to the problem is to convey the fluid by means of gravity.

In the prior art there obtain gravity-fed drinking aids, and exemplary thereof is the Drinking-Cup for Invalids, disclosed in U.S. Pat. No. 162,640, issued on Apr. 27, 1875, to W. W. Fowler. The patented item, however, is rather complex, having an underlying valve-actuator for controlling a valve set in the bottom of the cup. Too, the fluid-conveying tube is screwed into the hollow stem, below the bowl of the cup, and is not articulated; therefore, the gravity flow can not be regulated by an angulation of the tube itself.

U.S. Pat. No. 4,573,631, issued to Michael Reeves, on Mar. 4, 1986, for a Disposable Straw, Lid and Cup Combination, employs an articulated straw which draws fluid from the bottom of the cup. Here too, however, the combination is a rather complex manufacture, and disposable. Further, the straw is articulated adjacent the top thereof and, as a consequence thereof, requires a vacuum drawing of the fluid.

What has long been needed is a simple container with accommodation for a controlled gravity flow from the bottom thereof, and a container which offers a long-life re-use.

It is an object of this invention, then, to set forth a drinking aid which solves the aforesaid problem, and which is not met with the limitations found in the prior art drinking aids.

It is particularly an object of this invention to set forth a drinking aid comprising a cylindrical container having (a) an open top, (b) a closed bottom, and (c) an annular wall; wherein said wall has an aperture formed therethrough in immediate adjacency to said closed bottom; and an elongate tube, having an articulated portion intermediate the length thereof; wherein said tube is in penetration of said aperture, with a fluid-sealing, interference fit, and an end thereof is confined within said wall.

Further objects of this invention, as well as the novel features thereof, will become more apparent by reference to the following description, taken in conjunction with the accompanying figures, in which.

Figure 1:
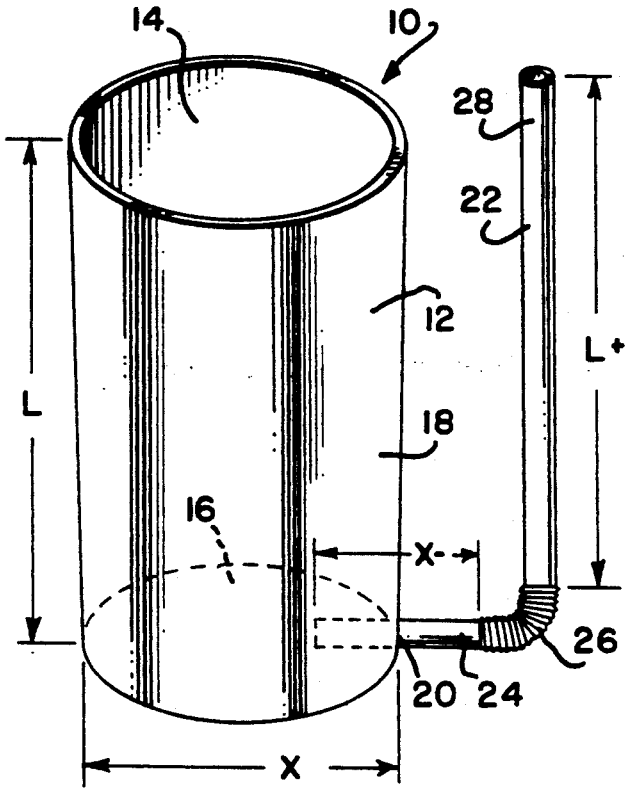
FIG. 1 is a perspective illustration of the invention, according to an embodiment thereof.
Figure 4:
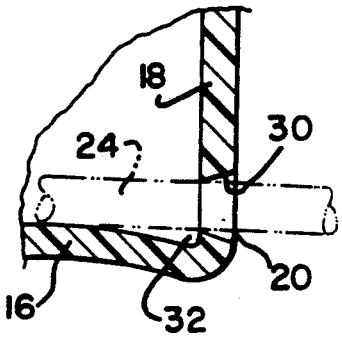
FIG. 4 is a greatly enlarged, cross-sectional view of the apertured area of the bottom of the container, only a fragmentary portion thereof being depicted.
Figure 3:
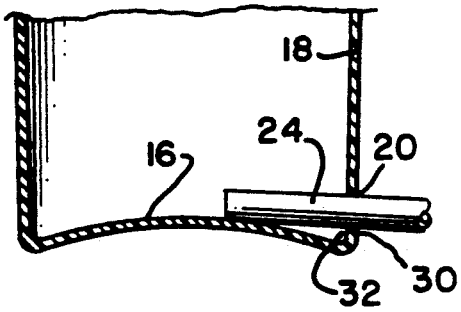
FIG. 3 is a cross-sectional view of the lower area of the container, showing the first extent of the tube therein.
Figure 2:
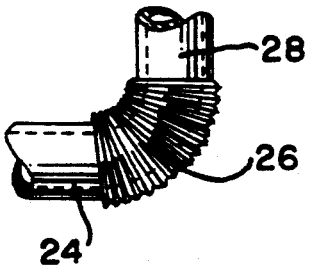
FIG. 2 is a depiction of a portion of the tube, i.e., the articulated portion thereof, the same enlarged over the scale of FIG. 1.

As shown in the figures, the novel drinking aid 10 comprises a container 12 of cylindrical form, having an open top 14, a closed bottom 16, and an annular wall 18. The wall 18 has an aperture 20 formed therethrough in immediate adjacency to the bottom 16. The aperture 20 receives an articulated tube 22. The tube 22 has a first extent 24, an articulated portion 26, and a second extent 28. The first extent 24 is slidably engaged with the aperture, defining thereof a fluid-sealing, interference fit therein.

The wall 18 has a given depth "L", and the second extent 28 of the tube 22 has a length "L+" which is greater than the aforesaid given depth of the wall 18. Too, the bottom 16 has a diameter "X", whereas the overall dimension of the first extent 24 of the tube 22 is "X−", i.e., of less dimension than said diameter. These relative dimensions insure that extent 28 can be raised to a level above that of the open top 14, and that the first extent 24 can be adjustably set in the aperture 20 without abutting the confronting side of the wall 18.

The articulated portion 26 is of accordian- or bellows-type, and defines the juncture of the extents 24 and 28 of the tube 22. The portion 26 offers adjustably selected rigidity; that is, sluing of the second extent 28 to some given angle, relative to the first extent 24, can be done with facility, but the portion 26 will hold the selected angle indefinitely. The portion 26 will accommodate an angle up to approximately ninety degrees of arc, and even when fully angled the fluid flow therethrough is not restricted. The accordian- or bellows-type pleating of the portion 26 occupies a greater diameter than the normal diameter of the first and second extents 24 and 28 of the tube 22 and, resultantly, does not intrude into the cross-section of the fluid-flow passage therewithin.

The outside diameter of the first extent 24 is almost identical to the inside diameter of the aperture 20, whereby the slidable, interference fit obtains. To facilitate an entry of the tube 22 into the aperture 20, the outermost periphery about the aperture 20 is tapered at 30. The bottom 16 is slightly domed, the latter arching toward the open top 14. With the first extent 24 of the tube 22 in penetration of the aperture 20, it set upon the domed interior of the bottom 16. Tube extent 24, then, bridges across a gutter 32, formed about the inner periphery of the bottom 16 due to the domed nature of the latter. Therefore, if the subject fluid, which is held in the container 12 happens to have some sediment, the latter will more readily deposit in the gutter 32. In bridging thereacross, then, the tube extent 24 effectively avoids ingesting such sediment.

As will be evident, the novel drinking aid 10 can be filled with fluid and presented to a subject for gravity-controlled flow of the fluid. The articulated portion 26 will allow the second extent 28 to be angled away from the container 12 to a position wherein the fluid just commences to flow out of the tube 22. Then the extent 28 can be lowered, gradually, progressively, to permit the fluid flow to continue, or can be angled upwardly, again, to cease the fluid flow. When the partaking of the fluid is completed, the tube 22 can be withdrawn from the container 12 and discarded. Then, the container can be thoroughly cleansed, and it will be ready for subsequent usage with another, sterile tube 22.

While we have described our invention in connection with a specific embodiment thereof, it is to be clearly understood that this is done only by way of example, and not as a limitation to the scope of our invention, as set forth in the objects thereof and in the appended claims.

What is claimed is:

1. A drinking aid, comprising:

a cylindrical container having (a) an open top, (b) a closed bottom, and (c) an annular wall; wherein said wall has an aperture formed therethrough in immediate adjacency to said closed bottom; and an elongate tube, having an articulated portion intermediate the length of said tube; wherein said tube is in penetration of said aperture, with a fluid-sealing, interference fit, and an end of said tube is confined within said wall.

2. A drinking aid, according to claim 1, wherein:

said end of said tube has a termination which opens into said container; and said termination lies upon said closed bottom.

3. A drinking aid, comprising:

a cylindrical container having (a) an open top, (b) a closed bottom having a periphery, and (c) an annular wall; wherein said wall has an aperture formed therethrough in immediate adjacency to said closed bottom; and an elongate, dual-ended tube, having an articulated portion intermediate the length of said tube; wherein said tube is in penetration of said aperture, with a fluid-sealing, interference fit;

said tube has a first extent from one end of said tube to said portion, and a second extent from said portion to the opposite end of said tube;

said first extent is held in said aperture with said interference fit;

said closed bottom has a diameter of a given dimension; and said first extent of said tube has an overall dimension which is less than said given dimension.

4. A drinking aid, according to claim 3, wherein:

said tube is removable from said aperture.

5. A drinking aid, according to claim 3, wherein:

said first extent of said tube is slidably extendable into, and retractable from, said aperture.

6. A drinking aid, according to claim 5, wherein:

said wall has an inner surface, and an outer surface; and said outer surface of said wall has means, circumjacent said aperture, for facilitating insertion of said tube into said aperture.

7. A drinking aid, according to claim 6, wherein:

said tube insertion facilitating means comprises a tapered entry formed about said aperture.

8. A drinking aid, according to claim 3, wherein:

said articulated portion of said tube comprises means which, in response to a displacement of said second extent of said tube to a selected angle, relative to said first extent of said tube, holds said second portion in such selected angle.

9. A drinking aid, according to claim 8, wherein:

said means comprises a bellows-type juncture between said first and second extents of said tube.

10. A drinking aid, according to claim 9, wherein:

said juncture comprises means for accommodating angulation between said first and second extents of said tube up to ninety degrees of arc without restricting fluid flow through said tube.

11. A drinking aid, according to claim 3, wherein:

said wall has a given depth; and said second extent of said tube has an overall dimension which is not less than the dimension of said given depth.

12. A drinking aid, according to claim 3, wherein:

said closed bottom of said container has a slight dome which extends toward said open top, and defines an annular gutter about said periphery of said bottom; and said first extent of said tube bridges across said gutter.

* * * * *